US008985891B1

(12) United States Patent
Sharp et al.

(10) Patent No.: US 8,985,891 B1
(45) Date of Patent: Mar. 24, 2015

(54) POSTS FOR ROAD SAFETY BARRIER

(71) Applicant: Hill & Smith Limited, West Midlands (GB)

(72) Inventors: Graham T. Sharp, Bilston (GB); Sean Billingham, Wollescote (GB); John M. Walton, Doncaster (GB)

(73) Assignee: Hill & Smith Limited, West Midlands (GB)

( * ) Notice: Subject to any disclaimer, the term of this patent is extended or adjusted under 35 U.S.C. 154(b) by 0 days.

(21) Appl. No.: 14/282,172

(22) Filed: May 20, 2014

Related U.S. Application Data

(63) Continuation of application No. 14/262,501, filed on Apr. 25, 2014, which is a continuation of application No. 12/371,735, filed on Feb. 16, 2009, now abandoned, which is a continuation of application No. 10/942,240, filed on Sep. 15, 2004, now Pat. No. 7,497,640.

(30) Foreign Application Priority Data

Sep. 17, 2003 (GB) ..... 0321757.7

(51) Int. Cl.
*E01F 15/00* (2006.01)
*E01F 15/02* (2006.01)
*E01F 13/00* (2006.01)

(52) U.S. Cl.
CPC ..... *E01F 15/02* (2013.01); *E01F 13/00* (2013.01)
USPC ..... 404/6; 404/10; 256/13.1

(58) Field of Classification Search
CPC ..... E01F 15/02
USPC ..... 404/6, 9, 10; 256/13.1
See application file for complete search history.

(56) References Cited

U.S. PATENT DOCUMENTS 429,038 A 5/1890 Kerr, Sr.
620,950 A 3/1899 Morgan
(Continued)

FOREIGN PATENT DOCUMENTS

BE 657 233 A 4/1965
DE 1784768 A1 11/1971
(Continued)

OTHER PUBLICATIONS

European Patent Office, "Communication pursuant to Article 94(3) EPC", European Search Report, May 17, 2013, 7 pages.
(Continued)

*Primary Examiner* — Raymond W Addie
(74) *Attorney, Agent, or Firm* — Tomlinson Rust McKinstry Grable

(57) ABSTRACT

A road safety barrier having a plurality of ropes supported by posts rigidly mounted on or in the ground is described. Each rope is held in tension against the posts and supported in a notch or groove in a side of the posts. The ropes are released from a post and the post is not pulled from the ground when a vertical force is exerted on the rope. The ropes when weaved are tensioned against the posts and this gives use to a combined frictional resistance to displacement of the ropes relative to each post along the length of the safety barrier. The structure of at least some of the posts and/or their mounting with respect to the ground defines a minimum bending yield strength in a direction along the length of the barrier. This minimum bending yield strength is greater than the bending moment resulting from the combined frictional resistance forces acting on the post.

15 Claims, 3 Drawing Sheets

(56) References Cited

U.S. PATENT DOCUMENTS

| | | | | |
|---|---|---|---|---|
| 887,498 | A * | 5/1908 | McElhinney | 256/50 |
| 962,632 | A | 6/1910 | Frost | |
| 1,793,105 | A * | 2/1931 | Lidderdale | 294/86.1 |
| 1,793,106 | A | 2/1931 | Lindemuth | |
| RE22,060 | E | 4/1942 | Hayden et al. | |
| 2,861,122 | A | 11/1958 | Flower | |
| 3,266,778 | A | 8/1963 | Wogerbauer | |
| 3,292,909 | A | 12/1966 | Bianchi | |
| 3,351,322 | A | 11/1967 | Mueller | |
| 3,353,795 | A | 11/1967 | Muller | |
| 3,450,387 | A | 6/1969 | Thomas | |
| 3,521,862 | A | 7/1970 | Curtner | |
| 3,567,154 | A | 3/1971 | Yancey et al. | |
| 3,722,861 | A | 3/1973 | Anderson | |
| 4,223,872 | A | 9/1980 | Boal | |
| 4,357,001 | A | 11/1982 | Schmanski et al. | |
| 5,022,782 | A | 6/1991 | Gertz et al. | |
| 5,039,066 | A | 8/1991 | Stacey | |
| 5,085,409 | A | 2/1992 | Teixeira | |
| 6,065,738 | A | 5/2000 | Pearce et al. | |
| 6,454,244 | B1 | 9/2002 | Coulson | |
| 6,612,551 | B1 | 9/2003 | Roy | |
| 6,886,813 | B2 | 5/2005 | Albritton | |
| 6,962,328 | B2 | 11/2005 | Bergendahl | |
| 8,246,013 | B2 | 8/2012 | Mauer et al. | |
| 2002/0185639 | A1 | 12/2002 | Galivan | |

FOREIGN PATENT DOCUMENTS

| | | | |
|---|---|---|---|
| DE | 3533963 | A | 4/1986 |
| EP | 0 369 659 | A1 | 5/1990 |
| FR | 2516344 | A | 5/2002 |
| GB | 20178 | A | 0/1915 |
| GB | 1012212 | B | 12/1965 |
| GB | 1103873 | B | 2/1968 |
| GB | 1120959 | B | 7/1968 |
| GB | 2224529 | A | 5/1990 |
| WO | 96/29473 | A1 | 9/1996 |
| WO | 00/67264 | A1 | 11/2000 |
| WO | 02/18730 | A1 | 3/2002 |
| WO | 03/024205 | A1 | 3/2003 |

OTHER PUBLICATIONS

Australian Government IP Australia, "Examiner's first report on patent application No. 2004212563", Mar. 5, 2009, 2 pages.

Australian Government IP Australia, "Examiner's report No. 2 on patent application no. 2009201382", Nov. 1, 2011, 2 pages.

Australian Government IP Australia, "Examiner's report No. 3 on patent application No. 2009201382", Feb. 21, 2012, 3 pages.

The Patent Office, "Patents Act 1977: Search Report under Section 17(5)", Feb. 12, 2004, 3 pages.

The Patent Office, "Patents Act 1977: Examination Report under Section 18(3)", Mar. 23, 2006, 3 pages.

The Patent Office, "Patents Act 1977: Examination Report under Section 18(3)", Jun. 15, 2006, 5 pages.

Subramanian, Nataraj & Associates, "First Examination Report issued by the Patent Office", Jul. 8, 2008, 5 pages.

Australian Government IP Australia, "Examiner's first report on patent application No. 2009201382", Oct. 15, 2010, 3 pages.

* cited by examiner

POSTS FOR ROAD SAFETY BARRIER

CROSS REFERENCE TO RELATED APPLICATIONS

This application is a continuation of U.S. Ser. No. 14/262,501, filed Apr. 25, 2014, which is a continuation of U.S. Ser. No. 12/371,735, filed Feb. 16, 2009, which is a continuation of U.S. Ser. No. 10/924,240, filed Sep. 15, 2004, now U.S. Pat. No. 7,497,640, which claims priority to United Kingdom Patent Application No 0321757.7, filed Sep. 17, 2003.

FIELD

This invention relates to road safety barriers for use at the sides or central reservations of roads and motorways, and in particular these including a plurality of wire ropes interwoven and maintained under tension between supporting posts.

SUMMARY

A known wire rope road safety barrier, described in EP 0 369 659 A1, includes two pairs of wire ropes, one pair of upper ropes supported in slots provided in a number of posts and lying generally parallel to one another, and a lower pair of ropes held in tension against and in contact with opposite side edge surfaces of posts. Each lower cable follows a sinuous path and passes to a different one of the two side surfaces of the same post. Although this safety barrier design added substantially to the containment capability over an earlier two wire rope barrier, it is now recognized that there are disadvantages associated with the parallel arrangement of the upper ropes because they have very little connectivity/cohesion with the posts. Consequently the upper ropes behave less stiffly and have less energy absorption capability than the (interwoven) lower ropes. Also because of the vertical rigidity of the posts there is a possibility of an errant vehicle straddling the safety barrier and receiving an upward thrust leading to overturning of the vehicle, if the posts fail to collapse in time.

It is desirable to achieve a degree of pre-tensioning of the interwoven wire ropes such that the integrity of the barrier is maintained during the mediate post-crash period. However, a consequence of the pre-tensioning is a tendency for the interwoven ropes to grip the posts so tightly that their combined frictional grip in the direction of the line of the barrier exceeds the elastic bending strength of the posts in that direction. This can lead to posts located some distance away from the vehicle impact zone being pulled over by the ropes towards the vehicle to the extent that they are permanently deformed.

It is an aim of the present invention to provide a road safety barrier which alleviates the aforementioned problems.

According to the present invention, there is provided a road safety barrier comprising four or more ropes supported by posts rigidly mounted on or in the ground, each rope being held in tension against the posts and following a sinuous path between the posts.

In embodiments of the invention, the tensioning of the ropes against the posts gives rise to a combined frictional resistance to displacement of the ropes relative to each post or at least some of the posts along the length of the safety barrier. The structure of each post and/or its/their mounting with respect to the ground defines a minimum bending yield strength in a direction along the length of the barrier. This minimum bending yield strength is advantageously greater than the bending moment resulting from the combined frictional resistance forces acting on the post.

Notwithstanding the above requirement it is highly desirable that all (or most) of the posts exhibit a preferential mode of collapse in a direction along the length of the safety barrier, relative to a transverse direction, so that they do not project from the line of the fence after an accident.

Embodiments of the present invention may provide an enhanced vehicle restraint capability relative to the four-wire rope fence described in EP 0 369 659 A1 particularly in cases involving larger and heavier vehicles. Further ropes may be interwoven between the posts to create a multi-rope barrier in order to achieve an increased containment capability although additional ropes to the minimum four are preferably added in pairs so the total number of ropes is even. This is so that the barrier has a more consistent resistance to vehicle penetration along its length. The ropes may be arranged in pairs at different heights on the posts or alternatively each rope may be at a different height from the others. In the latter case, the dispersion of the ropes allows the barrier to better accommodate a wide variety of vehicle types/heights and reduces the risk of rope redundancy in terms of vehicle capture.

Rope supports may be provided on the posts for vertically locating the ropes thereon while permitting longitudinal movement in the direction of the plane of the barrier. The rope supports may be formed integrally in the posts, possibly by way of longitudinally disposed notches. Alternatively the ropes may be supported on frangible supports such as rollers mounted on the posts.

The posts may have an asymmetrical cross-sectional profile such that the post presents the same profile to oncoming traffic on both sides of the barrier. This is, when the post is installed in the ground, rounded corners of the post are presented to oncoming traffic travelling in opposite directions on either side of the barrier. For example, the cross-sectional profile of the post may be of "S" or "Z", preferably with rounded corners on the line of the bend so that a rounded corner is presented to oncoming traffic. The S-post is therefore to be preferred in the central reservation of dual carriageways where vehicles drive on the left-hand side of the road, whereas the Z-post is preferable in the near-side verges. The opposite choice would naturally prevail in right-hand drive countries.

Embodiments of the present invention are advantageous in that when a vehicle impacts the barrier, there is an enhanced vehicle containment/retardation capability and a reduced risk of post collapse or damage in the regions of the barrier up and downstream of the impact area.

BRIEF DESCRIPTION OF THE DRAWINGS

The invention will now be further described by way of example with reference to the accompanying drawings, in which like reference numerals designate like elements, and in which.

DESCRIPTION OF THE PREFERRED EMBODIMENTS

Figure 1:
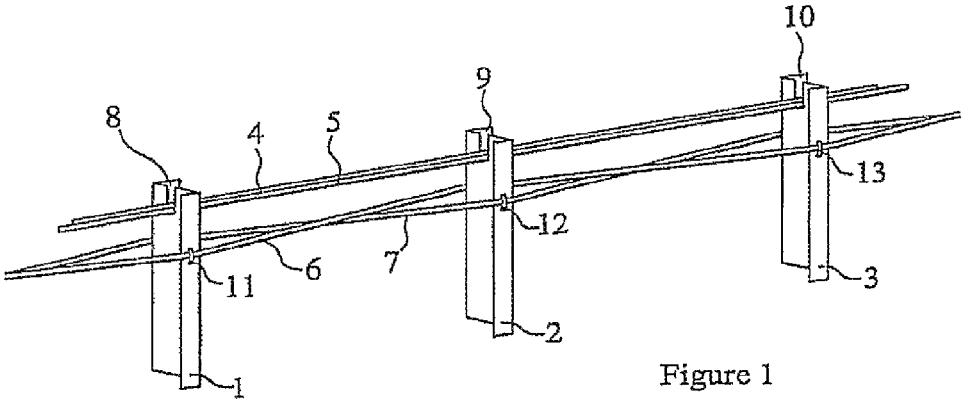
FIG. 1 shows part of a road safety barrier described in EP 0 369 659 A1.

In the arrangement shown in FIG. 1, posts 1, 2 and 3 are inserted into the ground (not shown) and support two pairs of wire ropes 4,5 and 6,7. The posts may be inserted into the ground either into recesses in pre-cast footings or by any other suitable means. The posts may be made from steel pressings having, for example, an "S" or "Z" cross-section such that a rounded corner of the line of the bend is offered to the direction of the traffic instead of a sharp edge. In addition the post shape will preferably present a smooth conforming surface to the ropes, and a smooth radiussed surface to any other impacting bodies so as to minimize the damage thereto under collision conditions.

The ropes 4, 5 of one pair are lying parallel to one another and supported within notches 8, 9 and 10 provided within respective posts 1, 2 and 3. The ropes 6,7 of the other pair are interwoven between the posts in the manner illustrated and supported in a vertical direction on the side of the posts by way of supports 11, 12 and 13. Each rope is maintained under tension so that the barrier provides an effective restraint to errant vehicles.

Figure 2:
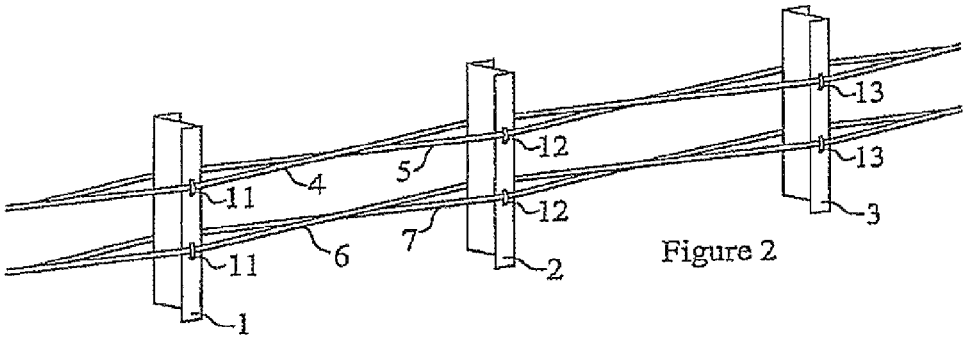
FIG. 2 shows a section of a road safety barrier according to a first embodiment of the present invention.
Figure 3:
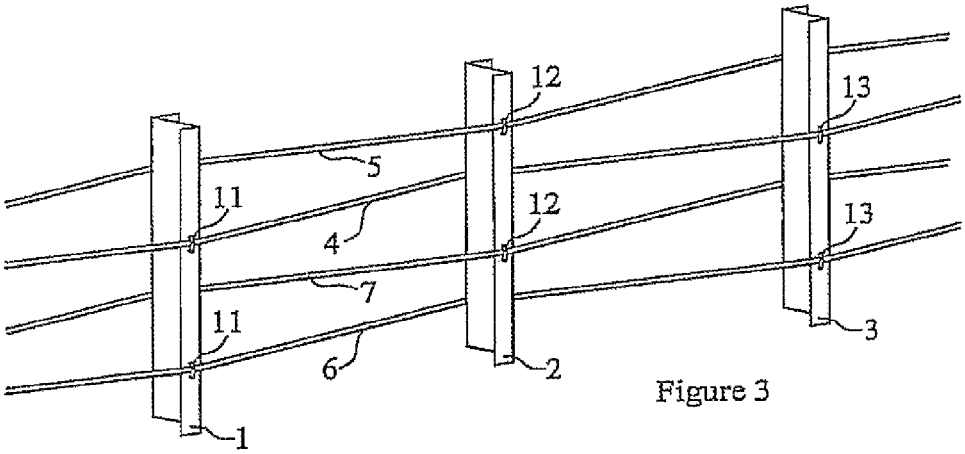
FIG. 3 shows a section of a road safety barrier according to a second embodiment of the present invention.

In the first embodiment of the present invention, as illustrated in FIG. 2, the ropes of both pairs 4, 5 and 6, 7 are interwoven about the posts 1, 2 and 3 instead of only the lower pair 6, 7. Each of the ropes is supported in a vertical direction on the side of the posts by way of supports 11, 12 and 13. The ropes of the first pair 4, 5 are at substantially the same height above the ground as one another and the ropes of the second pair 6, 7 are also at substantially the same height above the ground as one another but lower than the first pair. In the second embodiment, illustrated in FIG. 3, all of the ropes 4 to 7 are interwoven but instead of being arranged in two pairs vertically spaced apart from one another, all of the ropes are vertically spaced apart with respect to one another at different heights above the round. The first and second embodiments have the advantage, relative to the prior art arrangement illustrated in FIG. 1, that the containment capability of the barrier is improved and the risk of an impacting vehicle overturning is reduced for a wider range of vehicle weights and sizes. It is noted that FIGS. 2 and 3 illustrate a preferred method of interweaving in that each of the ropes passes from one side of the first post to the alternate side of the next one and so on progressively along the length of the barrier. It is preferred for the interweaving of half of the ropes to be arranged out of phase with the other half and in a manner which balances the potential bending moments on the respective posts, to ensure a consistent resistance to penetration (by vehicles) along the length of the barrier.

Figure 4A:
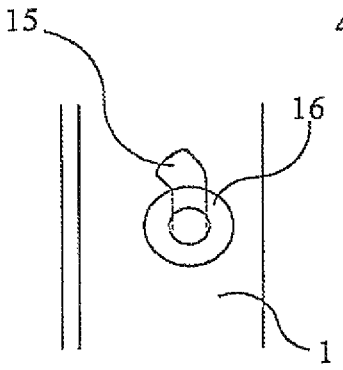
FIGS. 4*a* to 4*c* show a rope support which may be adopted in embodiments of the present invention.
Figure 4B:
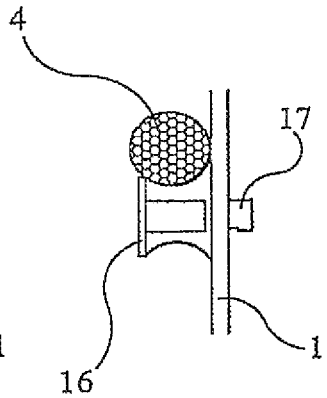
Figure 4C:
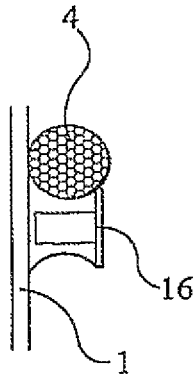

FIGS. 4*a* to 4*c* show rope supports which may be advantageously adopted in the posts of the embodiments of FIGS. 2 and 3. FIG. 4*a* shows a keyhole slot 15 formed in the wall of the post 1. A support roller 16 is mounted within the keyhole slot 15 and held therein by spigot 17. The roller 16 supports the wire rope 4 so that it is free to slide in the longitudinal direction of the safety barrier and free to move upwardly in the event of a vehicle impact. The roller supports are preferably frangible so that, in the event of a vehicle impact in which the posts fail to collapse towards the ground, the ropes are able to become detached from the posts more easily. Instead of supporting the ropes by way of the support roller 16 illustrated in FIGS. 4*a* to 4*c*, the ropes could be supported by a simple protuberance formed in the surface of the post.

Figure 4D:
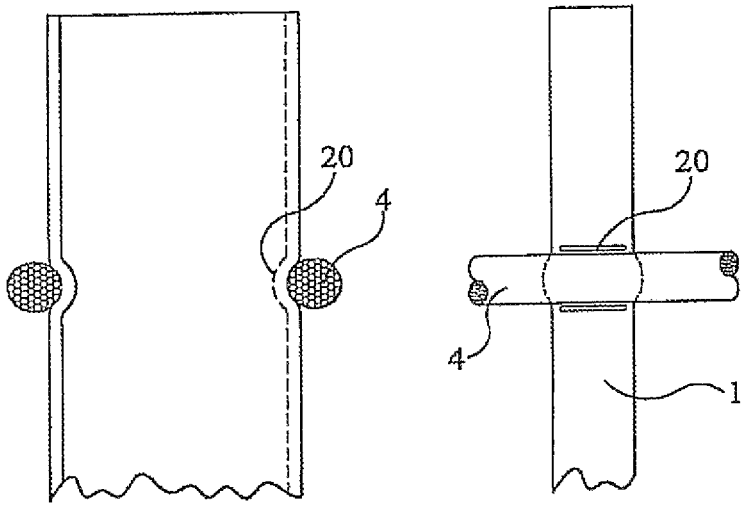
FIG. 4*d* shows an alternative rope support which may be adopted in embodiments of the present invention.

Alternatively, as illustrated in FIG. 4*d* which shows a part view of the post 1, the rope 4 may be located within shallow and longitudinally orientated grooves/depressions or notches 20 provided in flanges of the post section. This enables smooth supporting of the ropes as well as simple and accurate positioning thereof at predetermined heights on the one hand while allowing the ropes to be released from the notch if a significant vertical force is exerted on the rope. The release of the rope from the post 1 when subjected to an upward or downward force avoids them applying any upthrust to the vehicle and the possibility of the post 1 being pulled out of the ground.

Each of the ropes 4 to 7 is pre-tensioned by means of ground anchors at suitable intervals along the highway. The tension may be applied, for example, by temporary jacking means and adjustable rope anchorages, or by threaded end connectors and bottle screws (not shown). Intermediate tensioning means may be introduced to permit the end anchorages to be more widely separated.

During installation of the safety barrier, steps should be taken to ensure that the pre-tensioning of the wire ropes 4 to 7 is such that the tension is uniformly distributed along the barrier between the anchorage points.

In a preferred embodiment of the present invention, the yield strength of the posts in the longitudinal direction of the safety barrier exceeds the combined bending moments due to the normal frictional forces of the ropes on the posts under the expected tensions in the system. The significance of the post-rope frictional resistance and its bearing on the performance of the safety barrier will be explained in more detail below under the heading "Safety Barrier Crash Performance".

The posts should be designed to be secured in the ground in a manner capable of resisting the (longitudinal and transverse) bending moments on the post prior to and during its collapse under vehicle impact conditions, having regard to the prevailing ground conditions.

The post cross-section may be of any size and shape which satisfies the above criteria, and may vary in dimensions along the length of the barrier to reflect differing requirements, e.g. curves in the highway and/or changing post spacing.

Examples of possible Z-Post sections:

| Superficial dimensions of post cross-section mm | | | $2^{nd}$ Moment of Inertia $mm^4$ In plane of | |
|---|---|---|---|---|
| Depth | Width | Thickness | barrier | Normal to barrier |
| 100 | 32 | 5.0 | 59,000 | 914,000 |
| 100 | 32 | 6.0 | 66,700 | 1,064,000 |
| 100 | 40 | 6.0 | 125,000 | 1,280,000 |
| 110 | 40 | 6.0 | 130,000 | 1,625,000 |
| 110 | 50 | 6.0 | 242,000 | 1,960,000 |
| 120 | 40 | 6.0 | 135,000 | 2,016,000 |
| 120 | 50 | 6.0 | 245,000 | 2,420,000 |
| 120 | 50 | 8.0 | 307,000 | 3,070,000 |

It may also vary in flexural stiffness along the length of the post to take account of the varying bending moment. The type of section will therefore preferably lend itself to being manufactured by processes which can readily accommodate changes in size and shape without incurring prohibitive costs for tooling and the like.

The posts shall be of such a cross-section that they not only provide the barrier with adequate resistance to vehicle penetration (transverse to the line of the barrier) but also have a preferential mode of collapse in the direction of the line of the barrier. This is achieved by making the second moment of area of the posts in the longitudinal direction (in the plane of the barrier) significantly less than its second moment of area in the transverse direction (normal to the barrier) as illustrated in the above table. In order to comply safely with this requirement it is expected that the depth of the post cross-section is preferably in the region of 2-3 times the width thereof.

The constructional design detail of the rope tendons is believed non-critical to the initial functionality of the barrier so long as the ultimate strength and axial stiffness of the ropes are correctly specified, in keeping with the expected (crash) performance of the barrier. However the 19 mm diameter 3×7(6/1) rope is commonly used at present in this application and is a suitable rope for use in barriers embodying the present invention. This type of rope is favored both for ease of manufacture/handling, and for its structural integrity when subjected to mechanical abrasion/abuse. In addition it is substantially torque balanced under load which facilitates pre-tensioning and avoids undesirable rotational displacements in service.

However to optimize the functionality of the barrier in the immediate post-crash period steps should be taken to minimize the loss in rope tension when the barrier is impacted by a vehicle. In addition to ensuring that the barrier is uniformly pre-tensioned along its length, the ropes should be pre-stretched at a tension equivalent to 50% of their breaking strength, to remove initial stretch and elevate the elastic limit of the wire rope. Typically such ropes will have a minimum breaking strength of 174 kN and an axial stiffness of at least 23 MN.

The level of pre-tension applied to the wire ropes during installation of the barrier maybe regarded as an important variable in determining the crash performance of the barrier, with particular regard to vehicle deceleration rates and the permissible level of penetration beyond the line of the barrier. Normally for effective containment the ropes will be pre-tensioned to a tension equal to at least 10% of their breaking strength, and preferably to a tension equivalent to about 15% of their breaking strength and even up to a level equivalent to about 20% of their breaking strength where other design and practical considerations allow.

Safety Barrier Crash Performance

The use of parallel top ropes in the prior art barrier illustrated in FIG. 1 is advantageous in that it is easy to apply and maintain tension in those elements of the system. Specifically, the frictional resistance between the ropes and the post slots (in which they are a loose fit) is so low that that tension is readily transmitted over long lengths simply by tightening up the bottle screws at the anchorage points. This has the added benefit that in the event of a vehicle collision with the fence, there is little loss in tension in the top ropes and their functionality is largely maintained, thus preserving the integrity of the barrier until repairs can be effected. On the other hand, the use of interwoven top ropes increases the dynamic stiffness of the barrier and its energy absorption capability, thus improving the primary safety of the barrier.

Figure 5:
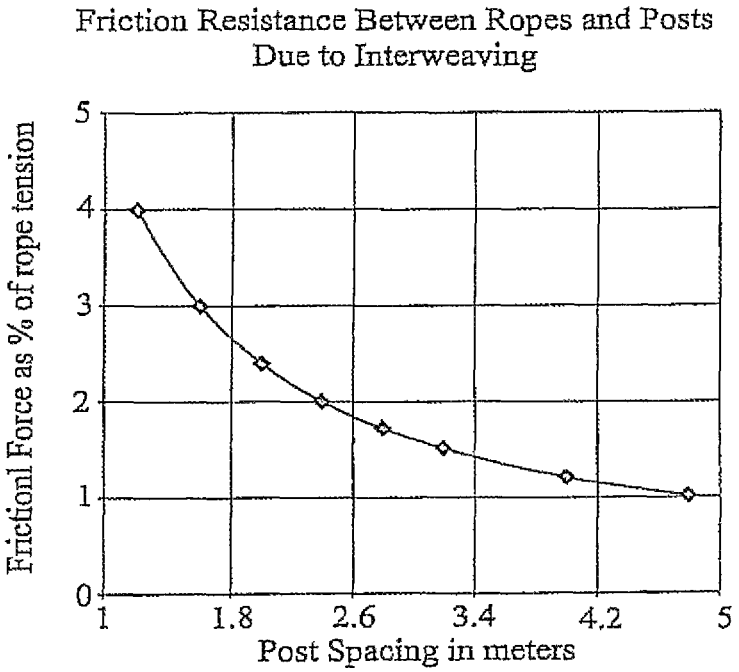
FIG. 5 is a graph showing frictional resistance between ropes and posts due to interweaving.

Embodiments of the invention adopt interwoven ropes in place of the prior art parallel top rope arrangement. However, interwoven ropes are more difficult to pre-tension, because the angular deflection of the ropes creates a proportional increase in the frictional resistance to movement between them and the posts. Typically the ropes are deflected from the line of the barrier by 2-3 degrees, but at shorter post spacing the angular deflection increases rapidly and may reach 5 degrees or more. The effect of this on the frictional resistance between the ropes and the posts is illustrated in FIG. 5 below. This figure takes the example of a 19 mm (¾") dia. rope on 100 mm (4") deep posts, and assumes a coefficient of friction=0.20.

This tensioning difficulty can be overcome by adopting an iterative tensioning procedure. The ropes may be tensioned up to or slightly beyond the desired level at the anchorage or tensioning points, and then the intervening posts (in the direction of the line of the fence) may be disturbed so as to promote rope slip and the re-distribution of the tension. This procedure is repeated to effect a progressive tensioning of the whole fence stage, up to the desired level.

Figure 6:
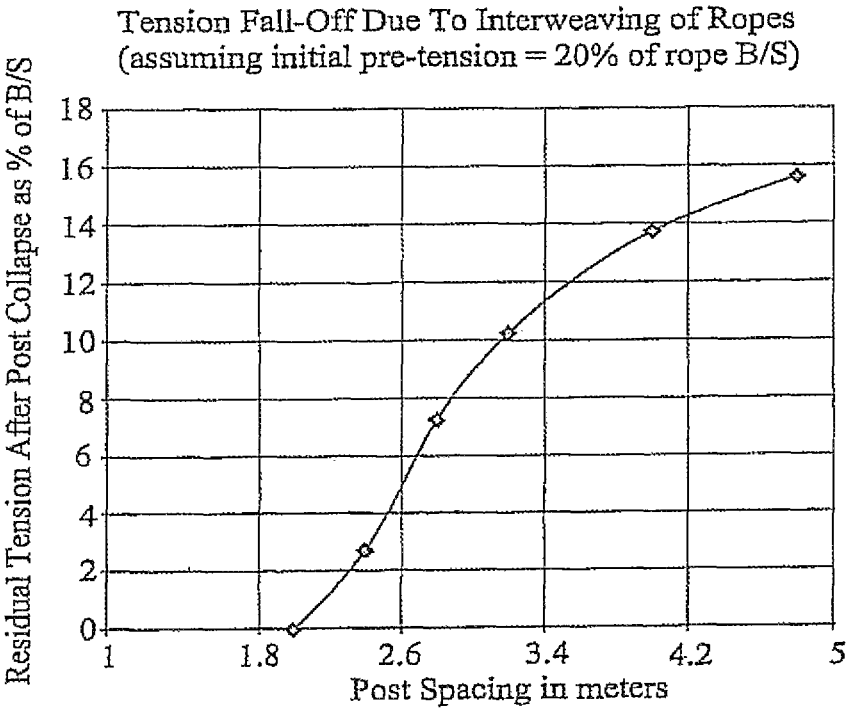
FIG. 6 is a graph showing tension fall-off due to rope interweaving.

Notwithstanding the effectiveness of this technique, the interwoven ropes suffer a significant loss in local tension when posts are collapsed by an impacting vehicle, as the angular (zigzag) deflection of the ropes is removed in the area of the collision. FIG. 6 (below) illustrates this effect graphically by considering one (or more) post bays in isolation from the rest of the fence and assuming that the ropes are initially pre-tensioned to 20% of the breaking strength (B/S) of the ropes.

This is admittedly a worst case scenario and in practice a considerable amount of these tension losses will be taken up by the undisturbed rope in the adjoining fence bays. Nevertheless the residual tension in the ropes will be significantly less than if they had not been interwoven. This emphasizes the need for effective pre-tensioning of the ropes to the recommended level, if a degree of barrier integrity is to be maintained in the immediate post-crash period.

A consequence of these effects is that the interwoven ropes will tend to grip the posts tightly such that their combined frictional grip in the direction of the line of the fence exceeds the elastic bending strength of the posts in that direction. When interwoven upper ropes are introduced, there is therefore the prospect of posts being pulled over by the ropes in positions not directly affected by an impacting vehicle. This presupposes that the rope displacements are sufficiently large to induce flexural yielding of the posts. Significantly the direction of this movement will be towards the colliding vehicle. Therefore, in accordance with a preferred aspect of the present invention, the posts are constructed and/or their attachment to the ground is such that the yield strength in bending of the posts (in the direction of the line of the fence) exceeds the combined bending moment of the rope frictional forces.

The move to a fully interwoven barrier system in accordance with the present invention further alleviates this problem. Embodiments may be provided with means for supporting the ropes, which are frangible at the posts. In the embodiment illustrated with reference to FIGS. 4*a* to 4*c*, the (roller) supports are mounted on spigots which readily shear in the event of substantial downward forces being applied.

Worked Example:

Consider the case of a 4-rope interwoven barrier in which the ropes have a mean heist above ground level of 550 mm and posts at 2.4 m spacing, each having a depth of 100 mm. The resulting angular deviation of the ropes (in plan view relative to the line of the barrier) will be 2.38 degrees. If we assume for design purposes that each rope will see a tension of 50 kN, then it can be shown that the four ropes will generate a frictional grip on a post of 3.33 kN (taking the coefficient of friction to be 0.20). The effect of this force is to create a bending moment in the post which will reach a maximum of 1832 Nm (at the base of the post) before the ropes slip. The result of this bending moment in terms of maximum bending stress will vary with the strength and stiffness of the type of post selected as illustrated in the table below:

Comparison of Maximum Bending Stresses in Z-Posts at 2.4 m centres:

| Post dimensions mm D × W × Thickness | In-line moment of inertial $mm^4$ | Combined bending moment Nm | Maximum bending stress $N/mm^2$ |
|---|---|---|---|
| 100 × 32 × 6.0 | 66,700 | 1832 | 439 |
| 100 × 40 × 6.0 | 125,000 | 1832 | 293 |
| 120 × 50 × 6.0 | 245,000 | 2197 | 224 |

[assumes 50 kN rope tension and 550 mm mean rope height]

With the Standard (100×32×6 mm) post it was found that the maximum bending stress greatly exceeded the yield strength of the post, which is 275 MPa [for Fe430A grade material]. The use of a larger (100×40×6.0 mm) post was therefore considered but the maximum bending stress still marginally exceeded the Fe430A yield strength. In this instance the problem could be solved by using a higher grade of steel post, e.g. Grade Fe510A which offers a yield strength of 355 MPa. A possible alternative solution would be to use a yet larger post such as the 120×50×6 mm section. Whilst this increases the angular deviation of the ropes and the bending moment slightly, the maximum bending stress falls to 224 MPa, well below the normal yield strength of 275 MPa.

Although intuition would suggest that post failure would be caused by direct impact of a colliding vehicle on the post, it appears that (for a pre-tensioned wire rope safety barrier) the mode of collapse of the posts is more generally attributable to the longitudinal components of the tensions in the ropes, as they are deflected by the ingress of the vehicle beyond the line of the barrier. The angular deflection of the ropes increases rapidly as the vehicle approaches the (first) post, up to the point at which the yield point of the post is reached, whereupon the ropes are released from the first post, to apply a similar progressive force (and bending moment) to the next post in line.

In an interwoven barrier, only the ropes that are on the upstream side of the post in question (i.e. lie between it and the oncoming vehicle) can act to pull it down. Hence, provision of an even number of ropes would render the barrier to a more consistent resistance to vehicle penetration along its length. Similar considerations apply to the selection of an optimum interweaving pattern for the ropes, if the ropes are not being paired at the same height.

It is noted that in embodiments of the present invention, the aforementioned problem of posts being pulled over is less apparent in the regions of the barrier close to the ends where the ropes are anchored to the ground. This is because at posts close to the barrier ends, the effective stiffness of the ropes increases due to the relatively short length thereof between the post in question and the anchorage point. Consequently, the ropes near the end positions of the barrier tend to deflect less under crash conditions relative to positions further away from the ends. As a result the frictional resistance of the ropes against the posts in these positions is less likely to deflect the post sufficient to cause yielding in bending. Therefore, posts near the anchorage ends of the barrier need not necessarily comply with the minimum bending yield strength of the present invention.

What is claimed is:

1. A safety barrier post secured on or in the ground, the post comprising:

a first side and a second side;

wherein the first side defines an indentation formed on a surface of the first side to receive and support a first wire rope and wherein a depth of the indentation from the surface is less than a diameter of the first wire rope;

wherein the first wire rope is held in tension against the indentation to withstand an impact from a vehicle; and such that the first wire rope is released from the indentation in an upwards or downwards direction when a vertical force is exerted on the first wire rope.

2. The post of claim 1 wherein the second side defines at least one indentation formed on a surface of the second side to receive and support a second wire rope and wherein a depth of the indentation from the surface is less than a diameter of the first wire rope such that the second wire rope is released from the indentation in an upwards or downwards direction when a vertical force is exerted on the second wire rope.

3. The post of claim 2 wherein the indentation on the first side is at substantially the same height as the indentation on the second side.

4. The post of claim 1 wherein the first side defines a second indentation to receive and support a second wire rope and wherein a depth of the second indentation from the surface is less than a diameter of the first wire rope, the second indentation vertically displaced from the first indentation such that the second wire rope is released from the second indentation in an upwards or downwards direction when a vertical force is exerted on the first wire rope.

5. The post of claim 1 wherein the indentation is vertically symmetrical.

6. A safety barrier post comprising:

an elongate member having a first side and a second side, and a first end secured in the ground;

wherein the first side defines at least one indentation formed on a surface of the elongate member to receive and support a first wire rope and wherein a depth of the indentation from the surface is less than a diameter of the first wire rope;

wherein the first wire rope is held in tension against the indentation to withstand an impact from a vehicle; and such that the elongate member is not pulled from the ground when a vertical force is exerted on the first wire rope.

7. The post of claim 6 wherein the second side defines at least one indentation formed on the second side to receive and support a second wire rope such that the elongate member is not pulled from the ground when a vertical force is exerted on the second wire rope.

8. The post of claim 6 wherein the first side defines a second indentation formed on the surface of the first side to receive and support a second wire rope such that the elongate member is not pulled from the ground when a vertical force is exerted on the second wire rope.

9. A road safety barrier comprising:

a plurality of posts rigidly mounted on or in the ground; and a plurality of wire ropes supported by the posts, the ropes held in tension along a length of the barrier;

wherein each of the posts comprises a first indentation and a second indentation, each of the first indentation and second indentation formed on a surface of the posts and wherein a depth of the first indentation and second indentation from the surface is less than a diameter of the first wire rope; and such the plurality of wire ropes is released from the first indentation and the second indentation in an upwards or downwards direction when a vertical force is exerted on the plurality of wire ropes.

10. The road safety barrier of claim 9 wherein the first indentation is arranged such that the post is not pulled from the ground when a vertical force is exerted on one of the wire ropes.

11. The road safety barrier of claim 9 wherein the first and second indentations are on opposite sides of each of the plurality of posts.

12. The road safety barrier of claim 9 wherein the first indentation is disposed at a first height on the post and the second indentation is disposed at a second height on the post.

13. The road safety barrier of claim 12 wherein the first indentation and the second indentation are on a first side of the post, such that the first height and the second height are vertically spaced apart.

14. The road safety barrier of claim 12 wherein the first indentation and the second indentation are on opposite sides of the post.

15. The road safety barrier of claim 14 wherein the first height and the second height are substantially the same.

* * * * *